US007028526B2

(12) United States Patent
Thudium et al.

(10) Patent No.: US 7,028,526 B2
(45) Date of Patent: Apr. 18, 2006

(54) DEVICE FOR CHANGING TOOLING

(75) Inventors: Karl Thudium, Waeschenbeuren (DE); Markus Buck, Geislingen (DE); Peter Sommerer, Eislingen (DE)

(73) Assignee: Schuler Pressen GmbH & Co. KG, Goeppingen (DE)

( * ) Notice: Subject to any disclaimer, the term of this patent is extended or adjusted under 35 U.S.C. 154(b) by 65 days.

(21) Appl. No.: 10/795,274

(22) Filed: Mar. 9, 2004

(65) Prior Publication Data

US 2004/0187549 A1 Sep. 30, 2004

(30) Foreign Application Priority Data

Mar. 28, 2003 (DE) ..... 103 14 077

(51) Int. Cl.
*B21D 43/05* (2006.01)

(52) U.S. Cl. ..... 72/405.05; 72/405.01; 198/621.1; 100/207

(58) Field of Classification Search ..... 72/405.08, 72/405.05, 405.01; 198/621.1; 100/207; 83/563

See application file for complete search history.

(56) References Cited

U.S. PATENT DOCUMENTS 4,970,888 A * 11/1990 Shiraishi et al. ..... 72/405.1
5,248,288 A * 9/1993 Kamiya et al. ..... 483/28
5,992,208 A * 11/1999 Hofele et al. ..... 72/405.08

FOREIGN PATENT DOCUMENTS

EP 575615 A1 * 12/1993

* cited by examiner

*Primary Examiner*—Daniel C. Crane
(74) *Attorney, Agent, or Firm*—Crowell & Moring LLP

(57) ABSTRACT

To accommodate a press tooling carrier without interference, a control arm straight guide having at least one drive, e.g., having motor angular gears (worm gears), cardan shaft or the like is provided. A control arm straight guide permits a very shallow position of the joints in the completely assembled state. A hydraulic cylinder may be used to support startup of the motor, i.e., to move the control arm straight guide out of its bottom dead center position.

16 Claims, 7 Drawing Sheets

DEVICE FOR CHANGING TOOLING

This application claims the priority of 103 14 077.8, filed Mar. 28, 2003, the disclosure of which is expressly incorporated by reference herein.

BACKGROUND OF THE INVENTION

The present invention relates to a sliding table for a press, in particular for a heavy parts transfer press.

Heavy parts transfer presses and other presses are often set up for production of different workpieces by changing die molds. A typical example is heavy parts transfer presses such as body presses for motor vehicles. Such presses are known as press installations and have sliding tables to accommodate the lower die during operation. For changing dies, the upper die is placed on the lower die and the sliding table moves this die unit laterally out of the press installation. Such die changing must be performed relatively frequently, because different sheet metal parts belonging to a vehicle body as well as sheet metal parts for different bodies are usually manufactured with a heavy parts transfer press.

For adaptation, however, it is necessary to change not only the die but also the so-called tooling. This includes apparatus for resetting the sheet metal parts in the transfer press, causing the sheet metal parts to be conveyed through the press installation. Such apparatus include, for example, lead frames which are mounted on so-called crossbars. They belong to a workpiece transfer device which has one to two crossbars for each press stage, i.e., for each die, depending on whether or not there are any intermediate places of deposit. When changing dies, the crossbars are also removed from the press installation. To do so, it is known that the crossbars can be placed on the sliding table together with the die-specific lead frames, so that the die with the respective tooling is moved out of the press.

In some cases, for example, the die must be removed from the sliding table to be replaced by another. Therefore, it is released from the sliding table and raised by a crane. This requires lateral access to the dies. If the tooling is also deposited on the sliding table, it is right next to the sliding table on the side, however, and is thus in the way. There is the risk of damage to the tooling. In addition, access to the die is difficult.

SUMMARY OF THE INVENTION

An object of the present invention is to create a sliding table which will permit facilitated changing of dies.

This object has been achieved by a sliding table having a table body having on a top side thereof a chucking surface for a die, a tooling receptacle device with connecting devices for accommodating and storing a crossbar and being mounted on the table body beneath a plane defined by the chucking surface, and an adjusting device for selectively adjusting the tooling receptacle device into a transfer position and at a sufficient distance above the chucking surface for transfer of a crossbar and into a storage position in which it is lowered beneath the plane defined by the chucking surface.

The inventive sliding table has a tooling receptacle device having connecting means for support of a crossbar. This tooling receptacle device is thus supported beneath a plane defined by the chucking surface of the sliding table. An adjusting device is provided for adjusting the tooling receptacle device from a resting or storage position located beneath the plane of the receptacle surface to a transfer position which is definitely above the die chucking surface. The adjusting device is thus a vertical adjusting device for the receptacle device. During operation, i.e., when the sliding table with the die has moved into the press installation, the receptacle device may be transferred to the storage position. The tooling receptacle device therefore does not cause interference while the press installation is in production. If minor disturbances occur or if the press must be accessed for some other reason, operating personnel has unhindered access to the dies.

For transfer of the tooling when changing dies, the tooling receptacle devices are adjusted vertically upward, however, so that the crossbars can be deposited on the tooling receptacle devices. The tooling receptacle devices are moved to such a height that the lead frames designed to be relatively extensive and are pivoted in the vertical direction are held above the die chucking surface or somewhat to the side next to the sliding table. If access to the die is to be created, then at first the relatively light and workpiece-specific lead frames can be removed by hand from the crossbars, for example. The crossbars, which are not usually workpiece-specific and which are relatively large and massive parts can then be lowered together with the tooling receptacle device until reaching a level beneath the die chucking surface. Then free lateral access to the dies is again ensured, so that the die is released from the sliding table and can be lifted by a crane, for example, without any risk for the relatively large and heavy but nevertheless sensitive crossbars. Free access to the dies is thus possible both during operation of the press installation, i.e., during production, and also in the resting state with the lead frames removed.

The tooling receptacle device and the respective adjusting device are preferably arranged in an interior space of the sliding table. Therefore, the crossbar (tooling carrier) is not only removed from the dangerous area of the dies to be changed but is also accommodated securely and in a protected manner. Furthermore, the interior space may have on its top side an opening through which the tooling receptacle device can be raised upward if necessary. This opening may be covered, for example, by a closure device, e.g., in the form of pivotable flaps. This is important for operating personnel who can then enter the press freely without interference from the adjusting device.

The tooling receptacle device preferably has two couplings which accommodate the crossbar near its ends. They are preferably arranged at a constant distance from one another, and this distance does not change as the tooling receptacle device is raised and lowered. Each coupling preferably executes a purely vertical movement.

Such a movement can be achieved by the fact that the adjusting device includes a lifting arm which is connected centrally to a bar, the length of which corresponds to half the length of the lifting arm. The lower end of the lifting arm is preferably guided horizontally in a straight guide, i.e., displaceably in parallel with the workpiece chucking surface, so that the other end of the lifting arm also executes a linear movement. The lifting arm thus transforms a horizontal adjusting movement, which is imposed on its lower end, into a vertical adjusting movement of the die receptacle device. This type of adjusting device has proven to be especially space saving. It is very shallow in its lower adjustment position, thus readily permitting accommodation even in relatively shallow sliding tables and especially lowering of the crossbar. On the other hand, a large lifting range is achieved, so that the die receptacle device in its upper position is so far above the die chucking surface that even tooling with relatively large lead frames can be accommodated.

The adjustment of the lifting arm can be performed with a linear driving device such as a threaded spindle, a ball threaded spindle, a traction gear such as a belt gear, cable gear or chain gear or a similar device. However, instead of the linearly displaceable end of the lifting arm, the bar to can driven by a slewing drive and for the lower end of the lifting arm to be guided freely in a guide. The guidance device is preferably parallel to the long sides of the table. The adjusting device therefore has a very space-saving configuration.

In addition, the driving device may also include a prestressing device which prestresses the lifting arm in the lifting direction. This is advantageous in particular when a linear drive which acts on the lower end of the lifting arm is provided as the driving device. The prestressing device supports the driving device in guiding the lifting arm out of its bottom dead center position. The prestressing device may be, for example, a prestressing device which applies a torque to the bar. A prestressing torque may also be applied to the lower end of the lifting arm.

BRIEF DESCRIPTION OF THE DRAWINGS

Other objects, advantages and novel features of the present invention will become apparent from the following detailed description of the invention when considered in conjunction with the accompanying drawings.

DETAILED DESCRIPTION OF THE DRAWINGS

Figure 1:
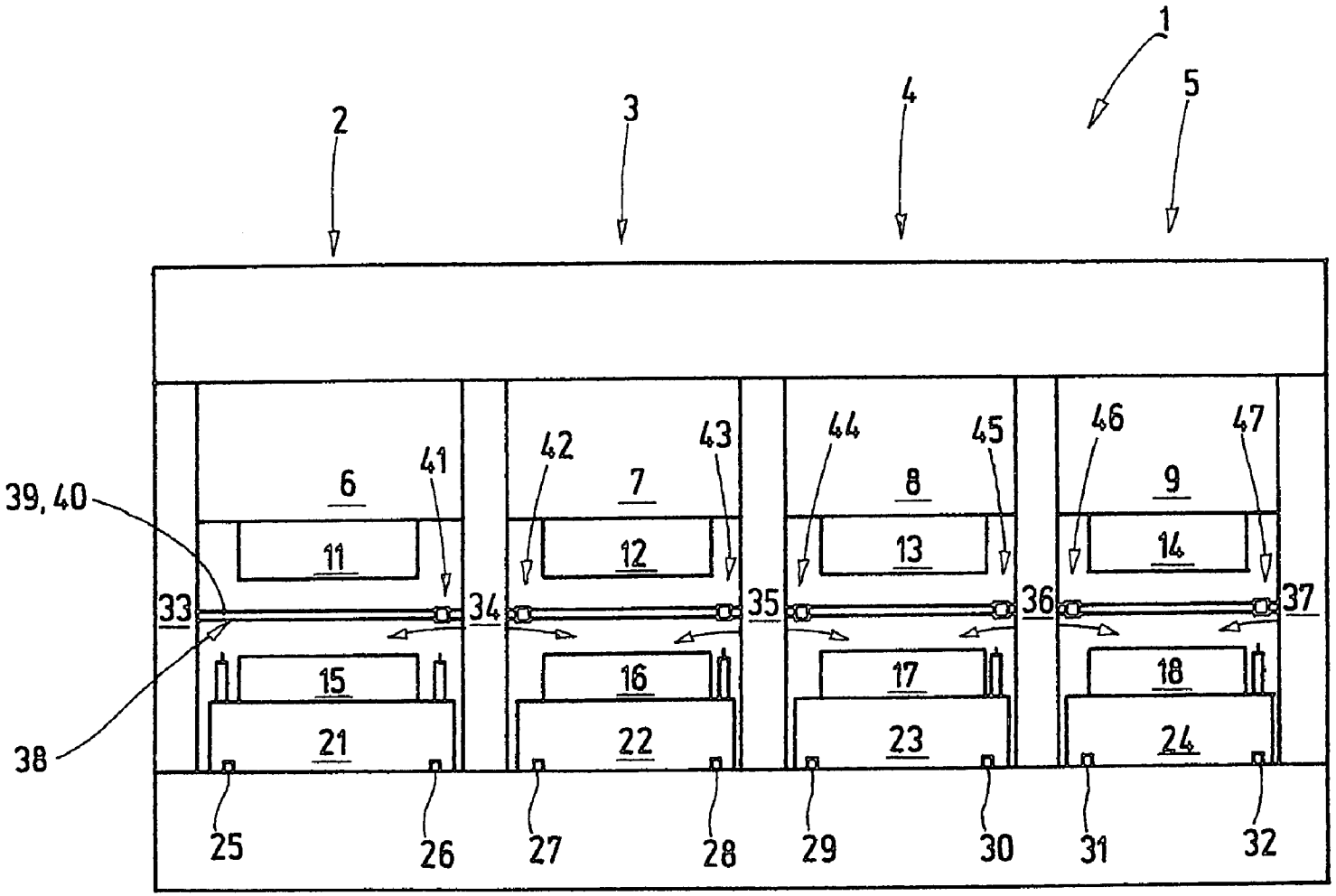
FIG. 1 is a schematic elevation view of a press installation having multiple press stages, sliding tables and a workpiece transfer device.

FIG. 1 shows a press installation 1 having multiple press stages 2, 3, 4, 5. A ram 6, 7, 8, 9 belongs to each press stage 2, 3, 4, 5, and all the rams 6, 7, 8, 9 are moved up and down in synchronization by a main press drive (not shown in detail). The press arms 6, 7, 8, 9 have upper dies 11, 12, 13, 14 which are paired with bottom dies 15, 16, 17, 18. The latter are mounted on sliding tables 21, 22, 23, 24 which can be run out laterally from the press installation 1 on rails 25 through 32 between adjacent press stands 33, 34, 35, 36, 37.

The press installation 1 also includes a transfer device 38 which provides the workpiece transport between the press stages 2, 3, 4 and 5. The transfer device 38 has guide rails 39, 40 which extend lengthwise through the press installation 1 on both sides of the transport path. In FIG. 1 the guide nails overlap. Bogie trucks that carry the tooling 41 through 47 are mounted on the guide rails 39, 40.

The sliding tables 21, 22, 23, 24 are explained in greater detail below on the basis of the example of the sliding table 21. The description of the sliding table 21 also applies accordingly to the other sliding tables.

Figure 2:
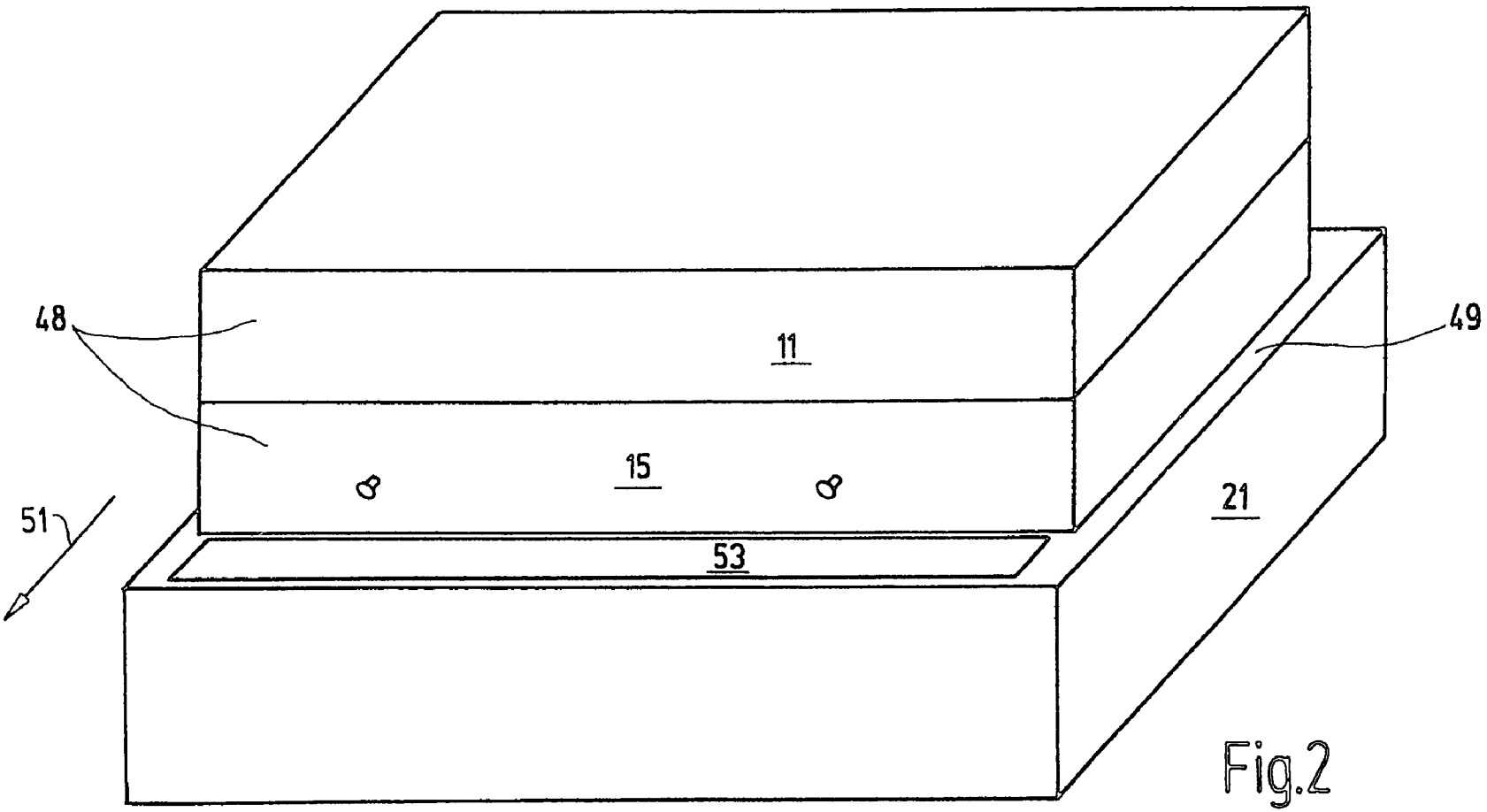
FIG. 2 is a schematic perspective view of a sliding table with a die arranged thereon.

FIG. 2 shows the sliding table 21 illustrated separately. It has the lower die 15 and the upper die 11 which is deposited on the lower die 15 for the purpose of changing dies, for example, and is shown here released from the ram 6. Conventional clamping claws or other chucking apparatus or connecting devices with which the bottom die 15 is mounted on the sliding table 21 are not illustrated further here for ease of understanding. The sliding table 21 has a chucking surface 49 which defines a horizontal plane to accommodate the die 48 consisting of the upper die 11 and the bottom die 15. The chucking surface 49 takes up only a small portion of the top side of the sliding table 21. The sliding table 21 projects above the workpiece 48 with respect to the parts of the transport device 51 indicated in FIG. 2.

Figure 3:
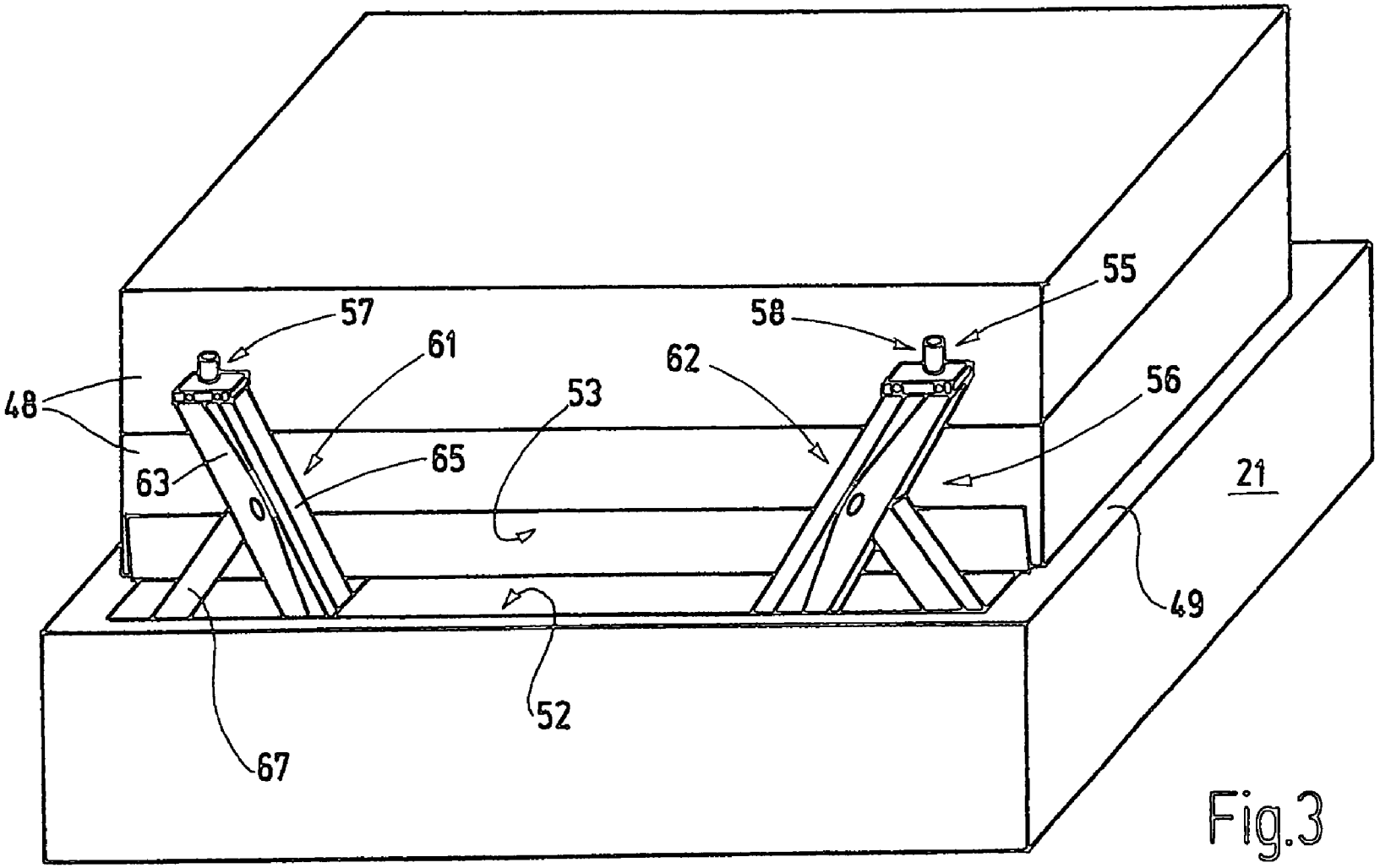
FIG. 3 is a schematic perspective view of the sliding table shown in FIG. 2 with the tooling receptacle device in the transfer position.
Figure 6:
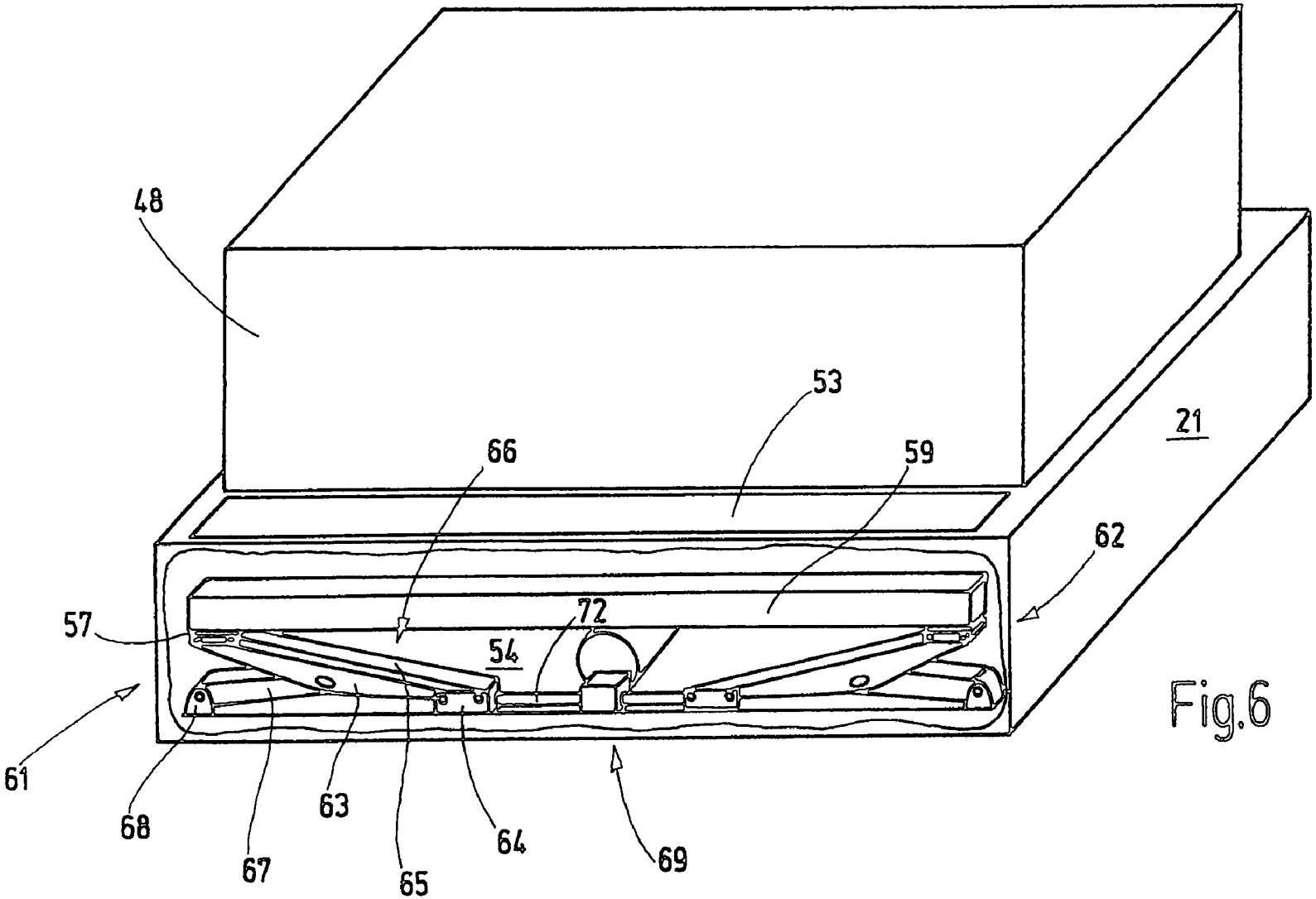
FIG. 6 is a schematic, partially cut-away perspective view of the sliding table shown in FIG. 5 with the crossbar transferred to the storage position.

The projecting part is provided to accommodate the tooling 41. This part is therefore provided with an opening 52 as shown in FIG. 3 and is covered by a flap 53. The flap is pivotably mounted on the long edge of the slotted opening 52 so that it can be flipped over, preferably toward the die 48. The opening 52 leads to an interior space 54 in which a tooling receptacle device 55 and a respective adjusting device 56 are arranged. The tooling receptacle device 55 is formed by two couplings designated generally by numerals 57, 58 which are set up for connecting a crossbar 59. The couplings 57, 58 are formed, for example, by journals that are directed vertically upward and taper toward the top, projecting away from a plate, and have corresponding openings in the crossbar 59 assigned to them. Their transfer position is shown in FIG. 3. In this position, they are held by the adjusting device 56 above the chucking surface 49 and/or a plane defined by it. They can be transferred to a storage position which is illustrated in FIG. 6 and in which they are held definitely below the chucking surface 49 and/or a plane defined by it.

The adjusting device 56 is formed, for example, by a lever gear with two partial mechanisms 61, 62 which are configured in mirror symmetry with one another. The following description of the partial mechanism 61 thus also applies accordingly to the partial mechanism 62.

The partial mechanism 61 includes a lifting arm 63 at the upper end of which the coupling 57 is mounted so it can pivot about a horizontal axis. As shown in FIG. 6, the opposite lower end of the lifting arm 63 is mounted in an articulated connection on a carriage 64 of a horizontal straight guide (not shown further here). In parallel with the lifting arm there is a strut 65 which is mounted at one end in an articulated connection on the carriage 64 and at its other end in an articulated connection on the coupling 57. The lifting arm 63 and the struts 65 form a parallelogram guide 66.

A bar 67 is connected centrally at one end to the lifting arm 63 and its other end is pivotably mounted on a swivel bearing 68 fixedly secured on the table. The carriage 64 is connected to a driving device 69 formed by a drive motor 71 which drives, for example, a threaded spindle 72 to rotate as needed. The latter forms a linear driving device for the carriage 64 in which is arranged a slide nut or a recirculating ball nut.

The driving motor 71 is preferably an electric motor, whereby the threaded spindle can drive both partial mechanisms 61, 62. To do so, it may be provided with opposing thread pitch on the two halves (right-handed thread and left-handed thread). Instead of this, two spindles with the same direction of pitch are also contemplated, in which case opposite directions of rotation are imposed on the two. This can be accomplished by an angular gear where conical wheels connected to the two spindles pick up their rotation on the opposing sides of a driving conical wheel. The thread pitch (angle of pitch) of the two spindles are then preferably equal.

Figure 7:
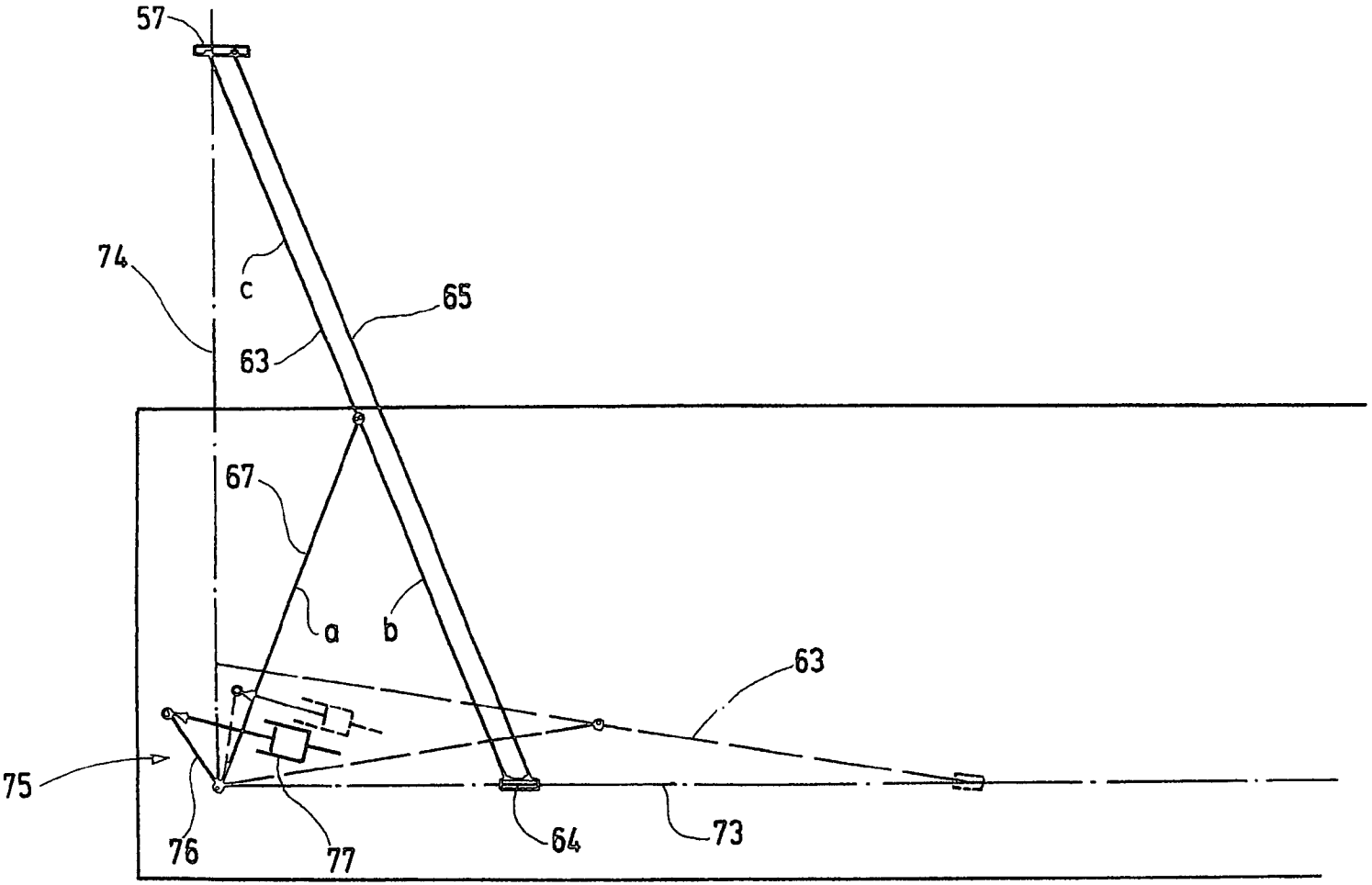
FIG. 7 is a schematic diagram of the kinematics of the adjusting device belonging to the tooling receptacle device according to the present invention.

FIG. 7 illustrates the kinematics of the partial mechanism 61. As this shows, the length a of the bar 67 measured between its swivel axes or axes of rotation corresponds to the partial length b of the lifting arm 63. The partial length b is measured between the swivel axis at the connecting point between the bar 67 and the lifting arm 63 and the swivel axis on the carriage 64. Thus, in each position of the lifting arm 63, the partial lengths a and b define an equilateral triangle. The partial lengths a and b thus also correspond to the length c measured between the swivel axis of the connecting point of the bar 67 with the lifting arm 63 and the swivel axis connecting the lifting arm 63 to the coupling 57. A horizontal path 73 predetermined by the linear guide is thus transformed into a vertical path 74.

In many cases it is advantageous to prestress the lifting arm 63 into its raised position. A prestressing device 75 is used for this purpose, generating a prestressing force directed upward. To this end, the bar 67 can be connected to a lifting arm 76 with which it forms an angle lever. A spring or the output of a fluid actuating device 77 may act on this lifting arm 76 as the prestressing device, e.g., in the form of a hydraulic cylinder or pneumatic cylinder or an electric drive.

Although the sliding table 21 is provided with a tooling receptacle device 55 and a respective adjusting device on both sides, the other sliding tables may be provided, for example, on only one side of the respective mold with corresponding receptacle devices and adjusting devices. If a sliding table has two adjusting devices, they may be driven by a common motor.

The press installation 1 and its sliding tables operate as follows in particular when changing dies. During operation of the press installation 1, the tooling receptacle device 55 is accommodated in the respective press table 21, 22, 23, 24 and is not visible on the outside. This is illustrated in FIG. 2 on the basis of the sliding table 21 in the phase where the die 48 is closed. Not only can the press installation 1 be operated unhindered but it may also be accessed, if necessary, in which the flaps 53 are closed but accessible.

Figure 4:
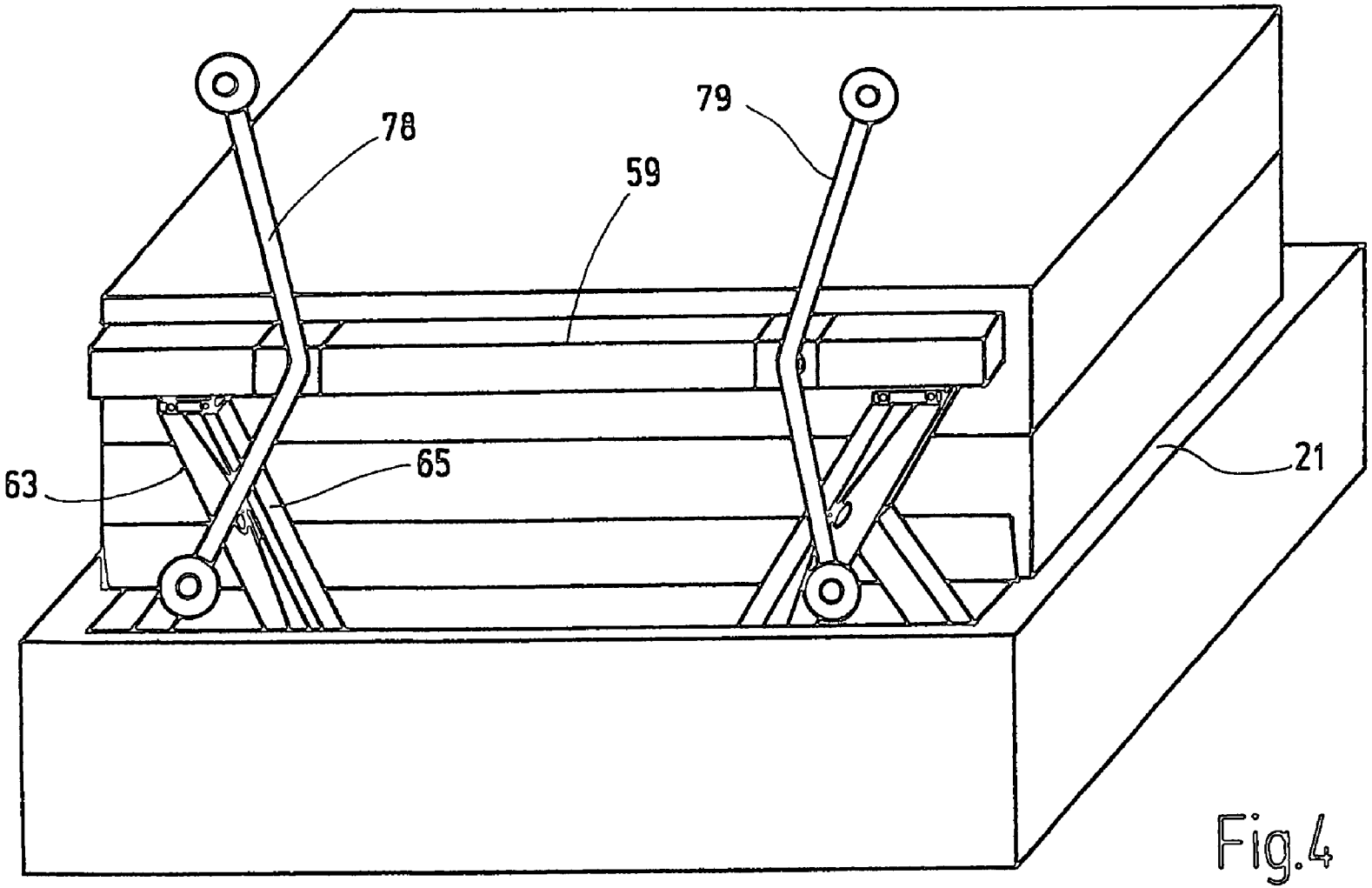
FIG. 4 is a schematic perspective view of the sliding table shown in FIG. 3 with the tooling deposited.

If a die change is to performed, the tooling receptacle devices 55 are moved into their transfer position, as shown in FIG. 3. To do so, the driving device 69 is operated so that the adjusting devices 56 move the tooling receptacle devices 55 upward. The lifting arms 63 are moved out of the position shown with dotted lines in FIG. 7 into the position shown with solid lines in FIG. 7. In this position, as illustrated in FIG. 4, a crossbar 59 with lead frames 78, 79 mounted on it can be deposited. The crossbar 59 couples thereby with the couplings 57, 58 by being placed on the vertical journals thereof and is released from their bogie truck (not shown here). The lead frames 78, 79 are pivoted 90° about the longitudinal axis of the crossbar 59 into the vertical position. In this condition, the sliding table 21, like any other sliding table 22, 23, 24, can be moved laterally out of the press installation 1.

Figure 5:
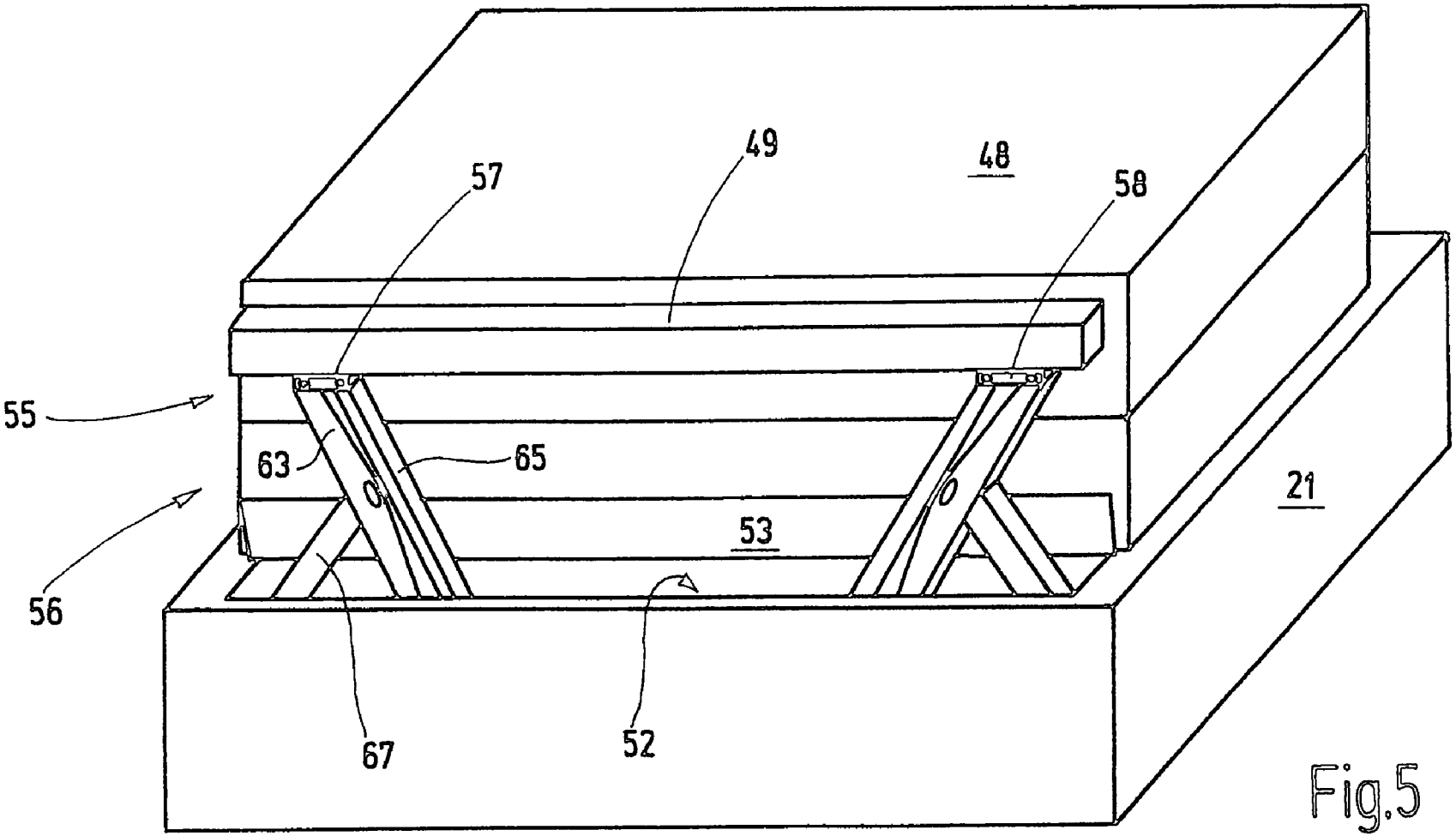
FIG. 5 is a schematic perspective view of the sliding table shown in FIG. 4 with the lead frame removed from the crossbar.

Once this has occurred, the lead frames 78, 79 illustrated in FIG. 4 can be removed, so that now only the crossbar 5 remains on the tooling receptacle device 55 as illustrated in FIG. 5. In addition, the adjusting device 56 is triggered again so that the tooling receptacle device 55 is transferred to its storage position according to FIG. 6. The crossbar 59 is then passed through the opening 52 into the interior space of the sliding table 21, after which the flap 53 closes. The crossbar 59 is now held in the interior of the sliding table 21. Free access to the die 48 is ensured all around. It can be released from the sliding table 21 and raised by a crane or other apparatus, thereby preventing any damage to the tooling. Reassembly of the sliding table 21 with the dies and tooling takes place in the reverse order.

When changing dies on press installations, the tooling carrier deposited on the sliding table should be moved out of the hazardous area of the dies to be changed. In addition, the mechanism for accommodating the tooling carrier should not interfere with access to the interior of the press installation. Therefore, to accommodate the tooling carrier, a control arm straight guide is provided, having at least one drive, e.g., a motor angular gear (worm gear), cardan shaft of the like. A control arm straight guide permits a very shallow position of the joints in the completely retracted condition. A hydraulic cylinder may be used to support startup of the motor, i.e., to move the control arm straight guide out of its bottom dead center position. Unlike known systems in which tooling receptacles are merely pivoted laterally away from the sliding table, the tooling of the present invention is accommodated in a protected manner by the sliding table itself. The control arm straight guide defines straight paths for the couplings 57, 58. Therefore, the tooling can be transferred to any desired height without any separate adjustment.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A sliding table for a press, including a heavy parts transfer press, comprising a table body having on a top side thereof a chucking surface for a die, a tooling receptacle device with connecting devices for accommodating and storing a crossbar and being mounted on the table body beneath a plane defined by the chucking surface, and an adjusting device for selectively adjusting the tooling receptacle device into a transfer position and at a sufficient distance above the chucking surface for transfer of a crossbar and into a storage position in which it is lowered beneath the plane defined by the chucking surface wherein the sliding table surrounds an interior space in which the tooling receptacle device and the adjusting device are arranged.

2. The sliding table as claimed in claim 1, wherein the interior space has an opening on a top side thereof positioned laterally next to the chucking surface and covered with a closing device.

3. The sliding table as claimed in claim 2, wherein the closing device is accessible.

4. The sliding table as claimed in claim 1, wherein two couplings are spaced at a constant distance from one another and belong to the tooling receptacle device.

5. The sliding table as claimed in claim 1, wherein the adjusting device includes a control arm straight guide.

6. The sliding table as claimed in claim 1, wherein the adjusting device includes a lifting arm and a driving device for adjusting an angular position of the lifting arm.

7. The sliding table according to claim 6, wherein the driving device includes a linear device for controlled displacement of the displaceable end of the lifting arm.

8. The sliding table according to claim 6, wherein the driving device includes a pretension device to apply pretension to the lifting arm in a direction of lifting.

9. A sliding table for a press, including a heavy parts transfer press, comprising a table body having on a top side thereof a chucking surface for a die, a tooling receptacle device with connecting devices for accommodating and storing a crossbar and being mounted on the table body beneath a plane defined by the chucking surface, and an adjusting device for selectively adjusting the tooling receptacle device into a transfer position and at a sufficient distance above the chucking surface for transfer of a crossbar and into a storage position in which it is lowered beneath the plane defined by the chucking surface wherein the sliding table surrounds an interior space in which the tooling receptacle device and the adjusting device are arranged, wherein the adjusting device includes a lifting arm which has the receptacle device on one end and horizontally displaceable a linear guide at its other end displaceable.

10. The sliding table as claimed in claim 9, wherein a strut is positioned parallel with the lifting arm and, together with the lifting arm, forms a parallelogram guide.

11. The sliding table as claimed in claim 10, wherein the lifting arm is sized to accommodate the strut.

12. The sliding table as claimed in claim 9, wherein the lifting arm is mounted pivotably centrally of a bar, the other end of which is held on a swivel bearing situated vertically beneath the receptacle device.

13. The sliding table as claimed in claim 12, wherein the lifting arm is twice as long as the bar.

14. The sliding table as claimed in claim 9, wherein the driving device includes a linear device for controlled displacement of the displaceable end of the lifting arm.

15. The sliding table as claimed in claim 9, wherein the driving device includes a pretension device to apply pretension to the lifting arm in a direction of lifting.

16. A sliding table, for a press including a heavy parts transfer press, comprising a table body having on a top side thereof a chucking surface for a die, a tooling receptacle device with connecting devices for accommodating and storing a crossbar and being mounted on the table body beneath a plane defined by the chucking surface, and an adjusting device for selectively adjusting the tooling receptacle device into a transfer position and at a sufficient distance above the chucking surface for transfer of a crossbar and into a storage position in which it is lowered beneath the plane defined by the chucking surface wherein the sliding table surrounds an interior space in which the tooling receptacle device and the adjusting device are arranged, wherein the storage position is located at a depth beneath a plane defined by the chucking surface such that a crossbar is also accommodateable beneath the plane.

* * * * *